US010260781B2

(12) United States Patent
Lin et al.

(10) Patent No.: US 10,260,781 B2
(45) Date of Patent: Apr. 16, 2019

(54) LIQUID COOLING DEVICE HAVING DIVERSION MECHANISM

(71) Applicant: COOLER MASTER TECHNOLOGY INC., New Taipei (TW)

(72) Inventors: Chun-Hung Lin, New Taipei (TW); Shui-Fa Tsai, New Taipei (TW)

(73) Assignee: COOLER MASTER TECHNOLOGY INC., New Taipei (TW)

( * ) Notice: Subject to any disclaimer, the term of this patent is extended or adjusted under 35 U.S.C. 154(b) by 593 days.

(21) Appl. No.: 14/474,260

(22) Filed: Sep. 1, 2014

(65) Prior Publication Data

US 2015/0059360 A1 Mar. 5, 2015

(30) Foreign Application Priority Data

Sep. 4, 2013 (CN) ..... 2013 2 0548045 U

(51) Int. Cl.

| | |
|---|---|
| ***F25B 21/02*** | (2006.01) |
| ***F25B 21/04*** | (2006.01) |
| ***F28D 1/03*** | (2006.01) |
| ***H05K 7/00*** | (2006.01) |
| ***F28F 3/04*** | (2006.01) |
| ***F28F 3/08*** | (2006.01) |
| *F28D 15/00* | (2006.01) |
| *F28F 3/12* | (2006.01) |

(52) U.S. Cl.

CPC ..... *F25B 21/02* (2013.01); *F25B 2321/0252* (2013.01); *F28D 15/00* (2013.01); *F28F 3/12* (2013.01)

(58) Field of Classification Search

CPC .... F25B 21/02; F25B 21/04; F25B 2321/025; F25B 2321/0251; F25B 2321/0252; F24D 2220/0235; F24D 2220/0292; G05D 23/13; F28F 3/04; F28F 3/086; F28F 9/0221; F28F 2250/08; H01L 23/36; F28D 1/03; F28D 2021/0028; H05K 7/20; H05K 7/2029

See application file for complete search history.

(56) References Cited

U.S. PATENT DOCUMENTS

| | | | | |
|---|---|---|---|---|
| 5,555,579 A * | 9/1996 | Wu | A47C 21/044 165/46 |
| 6,226,994 B1 * | 5/2001 | Yamada | F25B 21/02 136/203 |
| 7,508,671 B2 * | 3/2009 | Sauciuc | G06F 1/20 165/104.33 |
| 2004/0068991 A1 * | 4/2004 | Banney | F28F 1/045 62/3.7 |

(Continued)

*Primary Examiner* — Frantz F Jules
*Assistant Examiner* — Erik Mendoza-Wilkenfel
(74) *Attorney, Agent, or Firm* — Maschoff Brennan

(57) ABSTRACT

A liquid cooling device having a diversion mechanism, connected with a heat source, includes a thermoelectric cooler, a first water block, a second water block and a pump. The thermoelectric cooler has a cold end and a hot end. The first water block is disposed between the heat source and the cold end of the thermoelectric cooler. The second water block is disposed on one side of the hot end of the thermoelectric cooler. The pump connects the first water block and the second water block via a water pipe. Thereby, the temperature of an inner fluid is reduced and the overall heat dissipation effect of the device is improved.

11 Claims, 6 Drawing Sheets

(56) References Cited

U.S. PATENT DOCUMENTS

| | | | | |
|---|---|---|---|---|
| 2007/0045044 | A1* | 3/2007 | Sullivan | F01N 1/02 181/268 |
| 2008/0105413 | A1* | 5/2008 | Peng | F28F 3/048 165/104.33 |
| 2012/0024501 | A1* | 2/2012 | Campbell | H05K 7/2079 165/104.33 |
| 2012/0073309 | A1* | 3/2012 | Hung | F25B 21/02 62/3.3 |
| 2012/0110734 | A1* | 5/2012 | An | A47C 21/046 5/423 |
| 2012/0125013 | A1* | 5/2012 | Akiyama | B60H 1/00478 62/3.2 |
| 2014/0020676 | A1* | 1/2014 | Wehner | F24J 2/4625 126/663 |

* cited by examiner

LIQUID COOLING DEVICE HAVING DIVERSION MECHANISM

TECHNICAL FIELD

The disclosure relates to a cooling device, more particularly to a liquid cooling device used for a heat source from electronic components.

BACKGROUND

As shown in FIG. 1, currently a liquid cooling device mainly comprises a thermoelectric cooler 10 a, a water block 20 a, a pump 30 a and an air-cooled radiator 40 a. The thermoelectric cooler 10 a has a cold end 11 a and a hot end 12 a. The cold end 11 a of the thermoelectric cooler 10 a is attached to a heat source 90 a, while the water block 20 a is attached to the hot end 12 a of the thermoelectric cooler 10 a. The pump 30 a connects the water block 20 a and the air-cooled radiator 40 a via a water pipe 50 a. Thus, these components are combined to form a liquid cooling device.

The current liquid cooling device, however, is not without problems. Since the temperature changes of the hot end 12*a* and the cold end 11*a* of the thermoelectric cooler 10*a* are in a balance state (namely heat generated at the hot end 12*a* and heat dissipated at the cold end 11*a* being equal), the temperature of the fluid in the internal circulation of the water block 20*a* is unable to be lowered effectively. Additionally, the cooling effect at the cold end 11*a* to the heat source 90*a* is limited for the same reason.

SUMMARY

The disclosure provides a liquid cooling device having a diversion mechanism. In the liquid cooling device, the pump connects each water block and each water block is attached to the cold end and the hot end of the thermoelectric cooler. Thereby, the temperature of the fluid inside is reduced and the performance regarding the heat dissipation of the device is improved.

For fulfilling the above-mentioned purposes, the disclosure provides a liquid cooling device having a diversion mechanism comprising:

a thermoelectric cooler having a cold end and a hot end;

a first water block disposed on one side of the cold end of the thermoelectric cooler;

a second water block disposed on one side of the hot end of the thermoelectric cooler; and a pump connecting the first water block and the second water block via a water pipe.

The liquid cooling device having the diversion mechanism further comprises a pair of heat transfer members. One of the heat transfer members is disposed between the cold end of the thermoelectric cooler and the first water block while the other heat transfer member is disposed between the hot end of the thermoelectric cooler and the second water block.

In the liquid cooling device having the diversion mechanism, the heat transfer member forms a plurality of cooling fins.

In the liquid cooling device having the diversion mechanism, the first water block comprises a main body, a water inlet joint and a water outlet joint. The main body is attached to the cold end of the thermoelectric cooler The water inlet joint and the water outlet joint are respectively plugged in and connected with the inside of the main body.

In the liquid cooling device having the diversion mechanism, the second water block comprises a main body, a water inlet joint and a water outlet joint. The main body of the second water block is attached to the hot end of the thermoelectric cooler. The water inlet joint of the second water block and the water outlet joint of the second water block are respectively plugged in and connected with the inside of the main body of the second water block.

In the liquid cooling device having the diversion mechanism, the water pipe comprises a main pipe, two secondary manifolds and a tee joint. Two ends of the main pipe are connected to the pump and the tee joint respectively. Two ends of one of the secondary manifolds are connected to the tee joint and the water inlet joint of the first water block, respectively. Two ends of the other secondary manifold are connected to the tee joint and the water inlet joint of the second water block, respectively.

In the liquid cooling device having the diversion mechanism, a separating plate is disposed in the inside of the main body. An upper channel and a lower channel are formed on two sides of the separating plate respectively. A loop channel is disposed on the ends of the upper channel and the lower channel. The upper channel is connected with the water inlet joint of the first water block while the lower channel is connected with the water outlet joint of the first water block.

The liquid cooling device having the diversion mechanism further comprises a air-cooled radiator connecting the first water block, the second water block and the pump via a liquid tube.

In the liquid cooling device having the diversion mechanism, the liquid tube comprises a main pipe, two secondary manifolds and a tee joint. The first water block comprises a water outlet joint. The second water block also comprises a water outlet joint. Two ends of the main pipe are connected to the pump and the tee joint respectively. Two ends of one of the secondary manifolds are connected to the tee joint and the water outlet joint of the first water block, respectively. Two ends of the other secondary manifold are connected to the tee joint and the water outlet joint of the second water block, respectively.

The liquid cooling device having the diversion mechanism further comprises a fan arranged on the air cooled radiator.

The liquid cooling device having the diversion mechanism further comprises a liquid storage container connected with the liquid tube.

The disclosure further provides another liquid cooling device having a diversion mechanism. This liquid cooling device is connected with a heat source and comprises:

a thermoelectric cooler having a cold end and a hot end;

a first water block disposed between the heat source and the cold end of the thermoelectric cooler;

a second water block disposed on one side of the hot end of the thermoelectric cooler; and a pump connecting the first water block and the second water block via a water pipe.

The liquid cooling device having the diversion mechanism further comprises a pair of heat transfer members, wherein one of the heat transfer members is disposed between the cold end of the thermoelectric cooler and the first water block while the other heat transfer member is disposed between the hot end of the thermoelectric cooler and the second water block.

In the liquid cooling device having the diversion mechanism, the heat transfer member forms a plurality of cooling fins.

In the liquid cooling device having the diversion mechanism, the first water block comprises a main body, a water inlet joint and a water outlet joint. The main body is attached to the cold end of the thermoelectric cooler. The water inlet joint and the water outlet joint are respectively plugged in and connected with the inside of the main body.

In the liquid cooling device having the diversion mechanism, the second water block comprises a main body, a water inlet joint and a water outlet joint. The main body of the second water block is attached to the hot end of the thermoelectric cooler. The water inlet joint of the second water block and the water outlet joint of the second water block are respectively plugged in and connected with the inside of the main body of the second water block.

In the liquid cooling device having the diversion mechanism, the water pipe comprises a main pipe, two secondary manifolds and a tee joint. Two ends of the main pipe are connected to the pump and the tee joint respectively. Two ends of one of the secondary manifolds are connected to the tee joint and the water inlet joint of the first water block, respectively. Two ends of the other secondary manifold are connected to the tee joint and the water inlet joint of the second water block, respectively.

In the liquid cooling device having the diversion mechanism, a separating plate is disposed in the inside of the main body. An upper channel and a lower channel are formed on two sides of the separating plate respectively. A loop channel is disposed on the ends of the upper channel and the lower channel. The upper channel is connected with the water inlet joint of the first water block while the lower channel is connected with the water outlet joint of the first water block.

The liquid cooling device having the diversion mechanism further comprises a air-cooled radiator connecting the first water block, the second water block and the pump via a liquid tube.

In the liquid cooling device having the diversion mechanism, the liquid tube comprises a main pipe, two secondary manifolds and a tee joint. The first water block comprises a water outlet joint. The second water block also comprises a water outlet joint. Two ends of the main pipe are connected to the pump and the tee joint respectively. Two ends of one of the secondary manifolds are connected to the tee joint and the water outlet joint of the first water block, respectively. Two ends of the other secondary manifold are connected to the tee joint and the water outlet joint of the second water block, respectively.

The liquid cooling device having the diversion mechanism further comprises a fan arranged on the air-cooled radiator.

The liquid cooling device having the diversion mechanism further comprises a liquid storage container connected with the liquid tube.

Moreover, experimental data indicates the liquid cooling device of the disclosure is capable of improving the performance regarding heat dissipation by 10 percent, compared to the current liquid cooling devices.

BRIEF DESCRIPTION OF THE DRAWINGS

The present disclosure will become more fully understood from the detailed description and the drawings given herein below for illustration only, and thus does not limit the disclosure, wherein.

DETAILED DESCRIPTION

Figure 1:
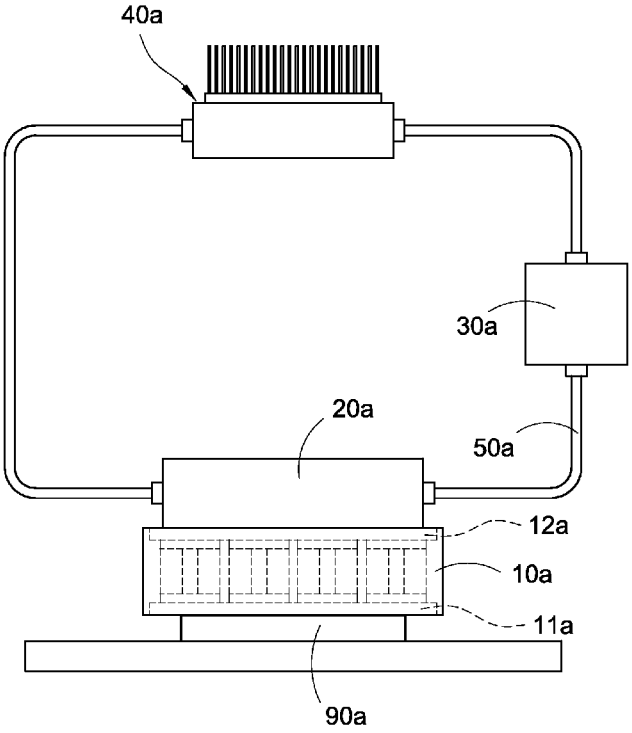
FIG.1 (Related Art)
FIG. 1 is a schematic view of the assembly of a current liquid cooling device.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
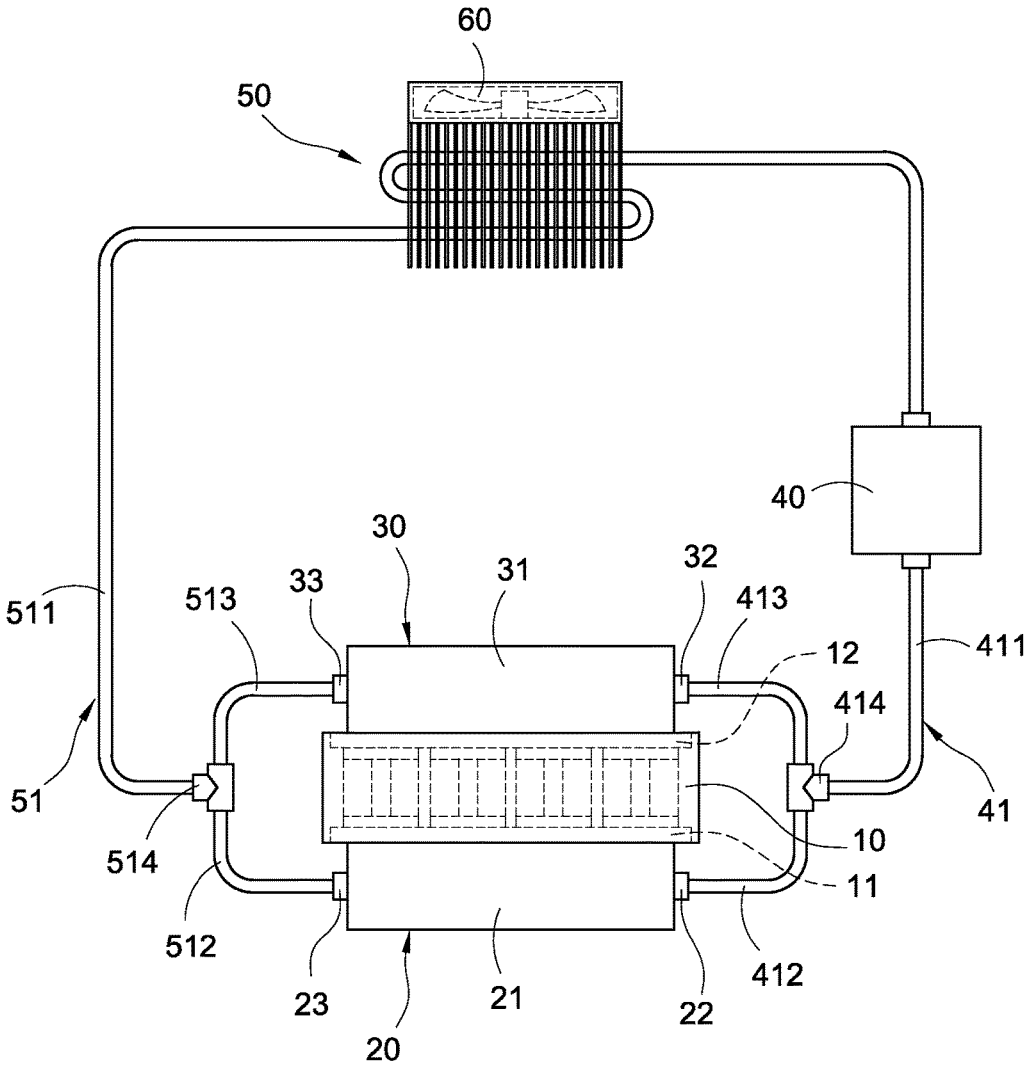
FIG. 2 is a schematic view of the assembly of a liquid cooling device according to one embodiment of the disclosure.

As seen in FIG. 2, a liquid cooling device having a diversion mechanism mainly comprises a thermoelectric cooler 10, a first water block 20, a second water block 30 and a pump 40.

The shape of the thermoelectric cooler 10 is similar to a rectangular body. The thermoelectric cooler 10 has a cold end 11 and a hot end 12. The first water block 20 comprises a main body 21, a water inlet joint 22 and a water outlet joint 23. The main body 21 is made of materials with good thermal conductivity. A plurality of channels and separating plates are disposed in the inside of the main body 21 (not shown in the figures). The water inlet joint 22 and the water outlet joint 23 are plugged into and connected with the main body 21 and connect the channels in the inside of the main body 21. The top surface of the main body 21 is attached to the cold end 11 of the thermoelectric cooler 10.

Similarly, the first water block 30 comprises a main body 31, a water inlet joint 32 and a water outlet joint 33. The main body 31 is made by materials of good thermal conductivity. A plurality of channels and separating plates are disposed in the inside of the main body 31 (not shown in the figures). The water inlet joint 32 and the water outlet joint 33 are plugged into and connected with the main body 31 and connect the channels in the inside of the main body 31. The top surface of the main body 31 is attached to the hot end 12 of the thermoelectric cooler 10.

The pump 40 connects the first water block 20 and the second water block 30 via a water pipe 41. The water pipe 41 comprises a main pipe 411, two secondary manifolds 412, 413 and a tee joint 414. Two ends of the main pipe 411 are connected to the pump 40 and the tee joint 414, respectively. Two ends of one of the secondary manifolds (412) are connected to the tee joint 414 and the water inlet joint 22 of the first water block 20 respectively, while two ends of the other secondary manifold (413) are connected to the tee joint 414 and the water inlet joint 32 of the second water block 30 respectively.

The liquid cooling device of the disclosure further comprises a air-cooled radiator 50. The air-cooled radiator 50 connects the first water block 20, the second water block 30 and the pump 40 via a liquid tube 51. The liquid tube 51 comprises a main pipe 511, two secondary manifolds 512 and 513 as well as a tee joint 514. Two ends of the main pipe 511 are connected to the pump 40 and the tee joint 514, respectively. Two ends of one of the secondary manifolds (512) are connected to the tee joint 514 and the water outlet joint 23 of the first water block 20 respectively, while two ends of the other secondary manifold (513) are connected to the tee joint 514 and the water outlet joint 33 of the second water block 30 respectively.

The liquid cooling device of the disclosure further comprises a fan 60 which is arranged on the air cooled radiator 50 for dissipating heat of the air cooled radiator 50, thereby lowering its temperature.

Figure 3:
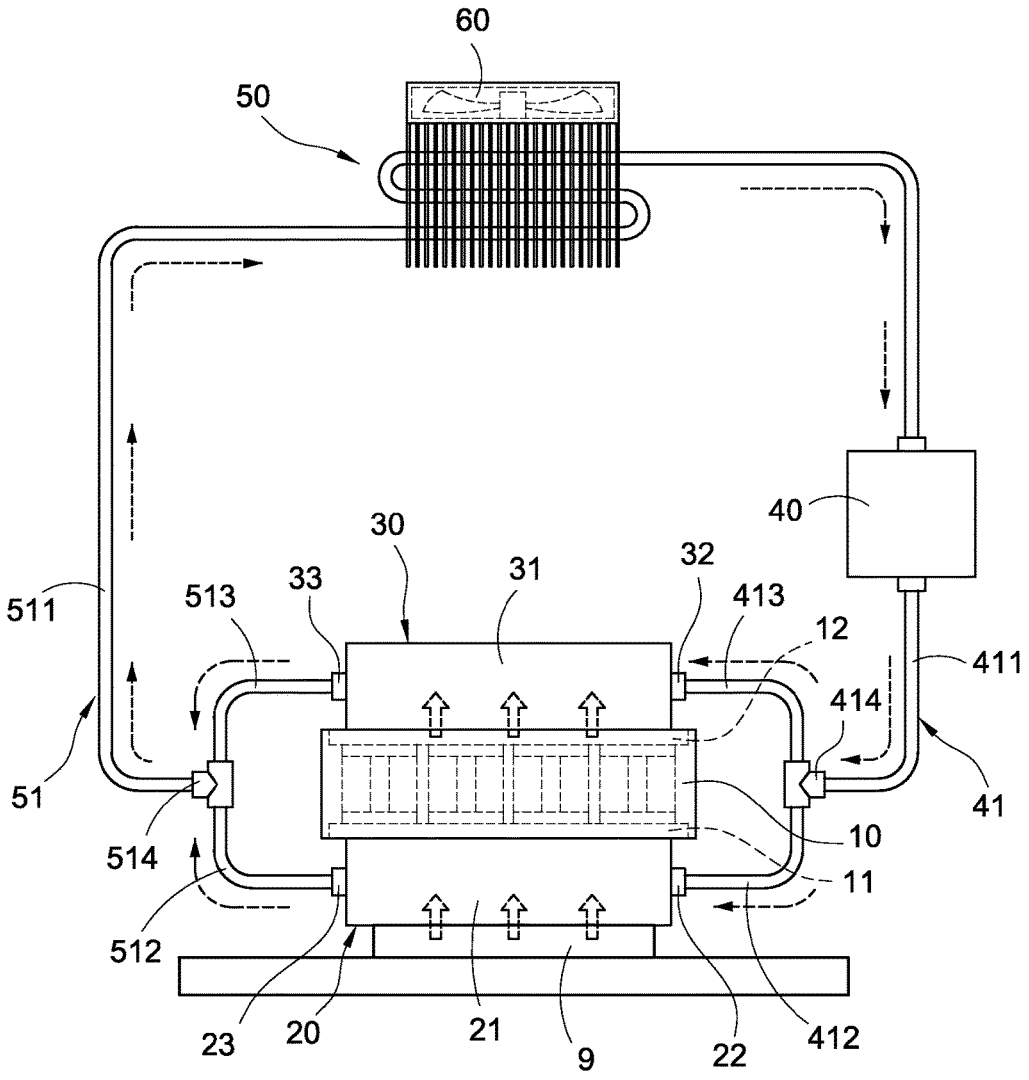
FIG. 3 is a schematic view of the usage of the liquid cooling device according to one embodiment of the disclosure.

As seen in FIG. 3, in the installation processes, the bottom surface of the first water block 20, which is away from the cold end 11 of the thermoelectric cooler 10, is attached to the top surface of a heat source 9. The pump 40 makes the fluid of coolant output from the water pipe 41 and the fluid flows through the main pipe 411 as well as the secondary manifolds 412 and 413. A part of the fluid flows into the first water block 20 via the water inlet joint 22 while the other part of the fluid flows into the second water block 30 through the water inlet joint 32. At this point, heat generated by the heat source exchanges heat with the fluid passing through the first water block 20 and the cold end 11 of the thermoelectric cooler 10 may also cool down the fluid in the first water block 20. Thereby, the heat source 9 is continuously operating in a low operating temperature. Furthermore, the hot end 12 of the thermoelectric cooler 10 is attached to the bottom surface of the second water block 30 and the heat is dissipated by the fluid flowing through the second water block 30. Then, the liquid tube 51 connecting the first water block 20, the second water block 30 and the pump 40, along with the help of the air cooled radiator 50 and the fan 60, form a liquid cooling device with a continuous cycle.

Figure 4:
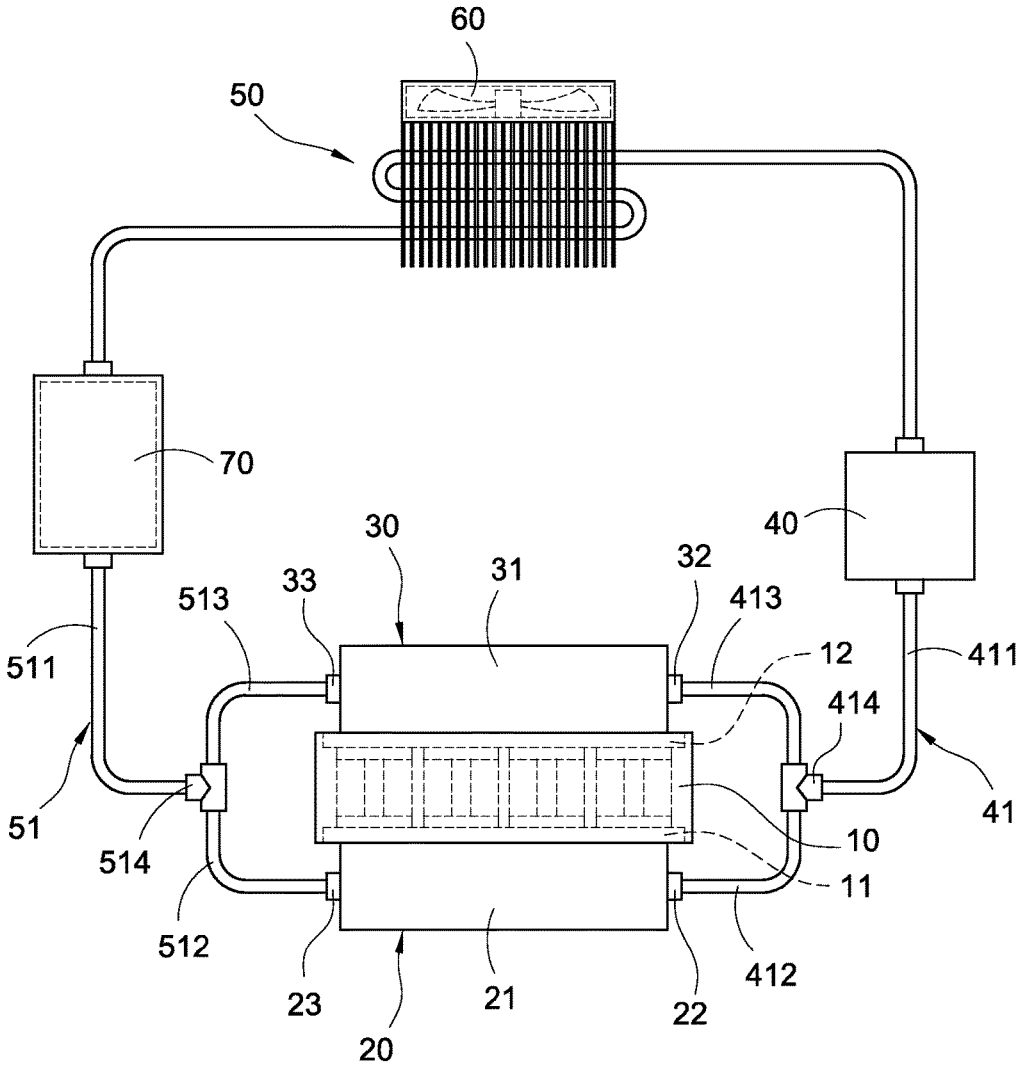
FIG. 4 is a schematic view of the assembly of a liquid cooling device according to another embodiment of the disclosure.

As shown in FIG. 4, in this embodiment, the liquid cooling device further comprises a liquid storage container 70. The liquid storage container 70 is arranged on the path of the main pipe 511 for mixing the fluid output by the first water block 20 and the second water block 30 and for performing heat exchange. After the actions of the air-cooled radiator 50 and the fan 60, the liquid tube 51 outputs it to the pump 40 for the next heat exchange.

Figure 5:
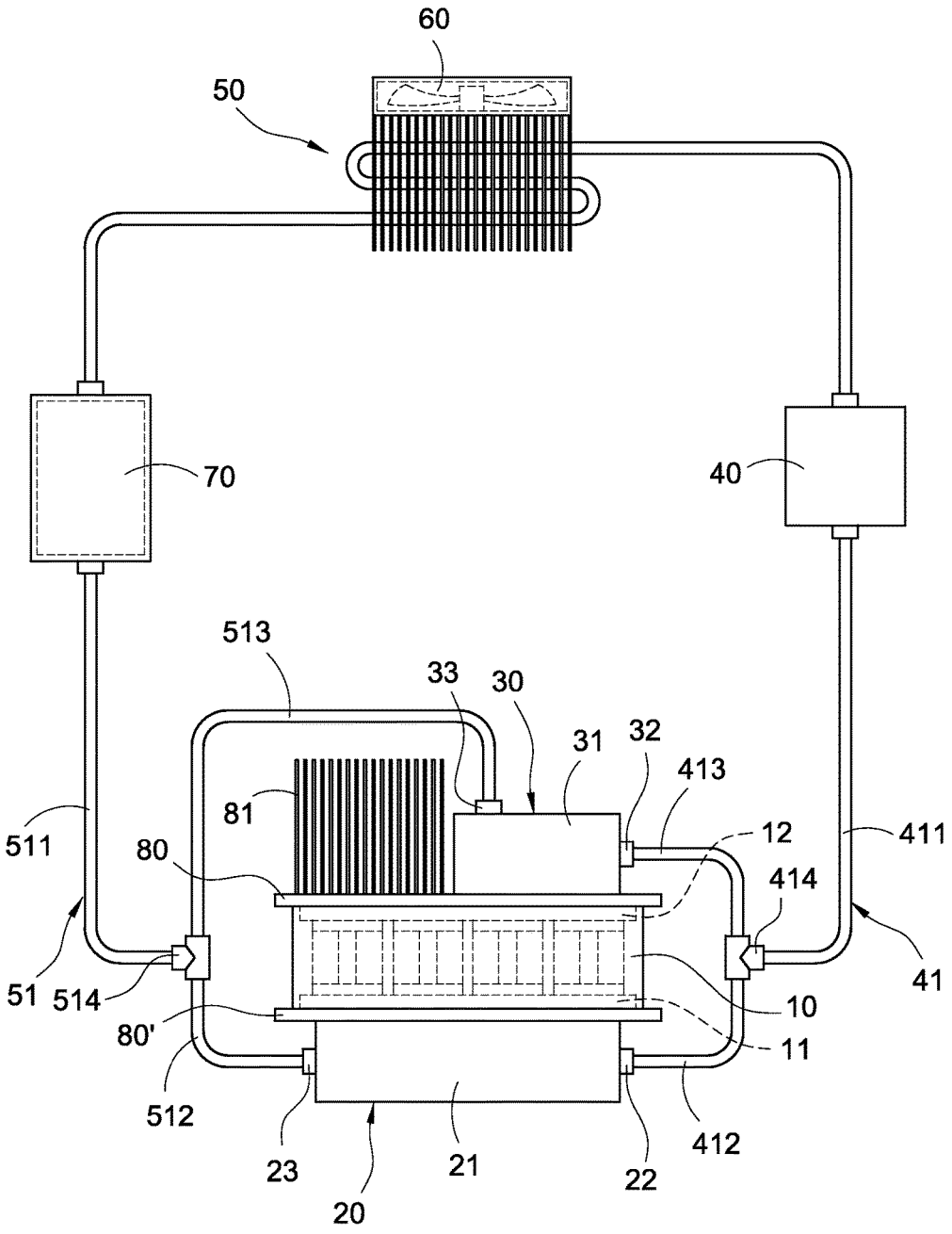
FIG. 5 is a schematic view of the assembly of a liquid cooling device according to still another embodiment of the disclosure.

As seen in FIG. 5, the liquid cooling device of the disclosure further comprises a pair of heat transfer members 80 and 80'. The lower one of the heat transfer members (80') is disposed between the cold end 11 of the thermoelectric cooler 10 and the first water block 20 while the upper one of the heat transfer members (80) is disposed between the hot end 12 of the thermoelectric cooler 10 and the second water block 30. The heat transfer members 80 and 80' may be made of materials with good thermal conductivity, such as copper. The upper heat transfer member 80 further comprises a plurality of cooling fins 81, which are parallel to each other and arranged at intervals, for improving heat dissipation effects.

Figure 6:
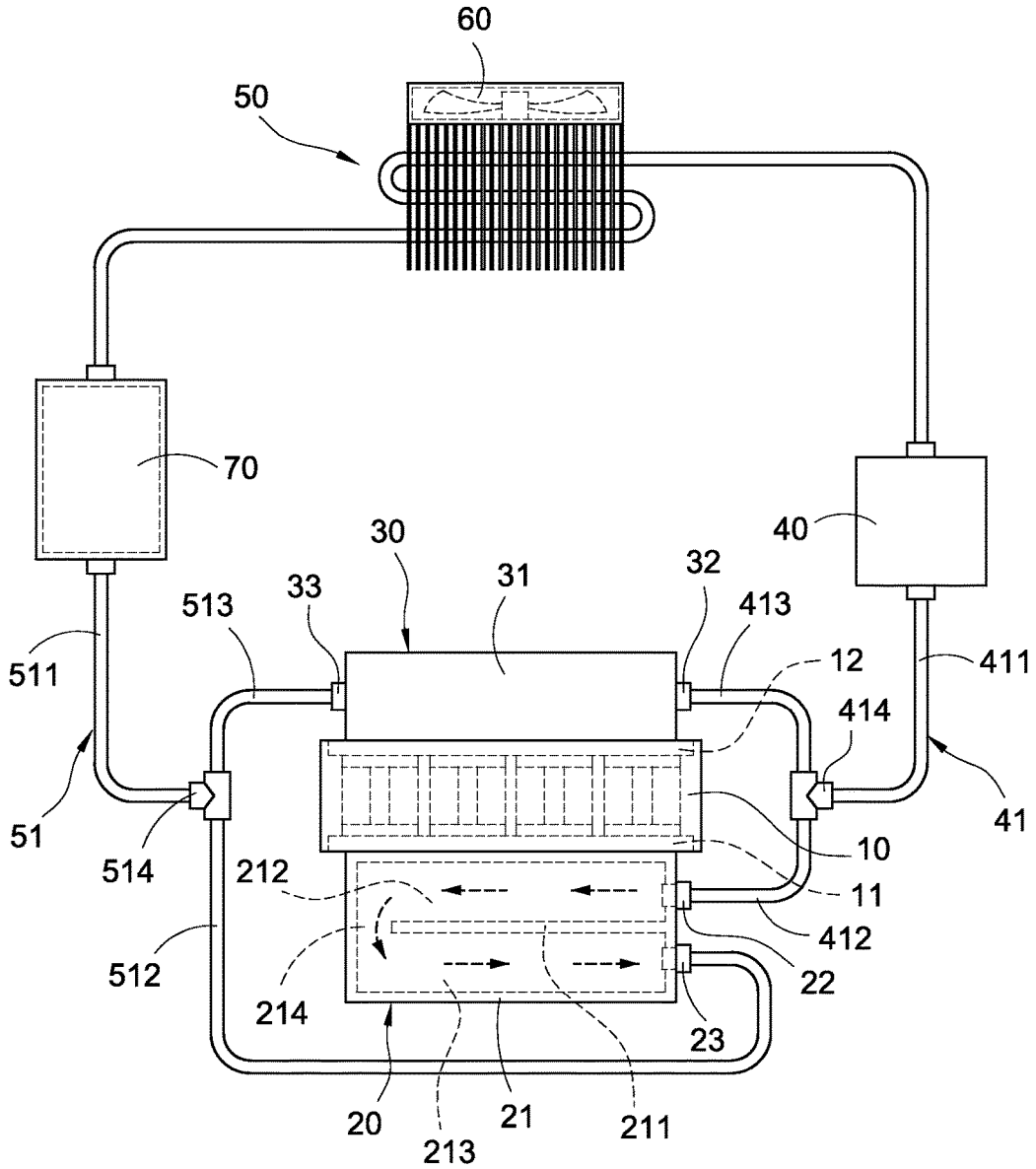
FIG. 6 is a schematic view of the assembly of a liquid cooling device according to the other embodiment of the disclosure.

As shown in FIG. 6, a separating plate is disposed in the inside of the main body 21 of the first water block 20. An upper channel 212 and a lower channel 213 are disposed on two sides of the separating plate 211, respectively. A loop channel 214 is disposed on the ends of the upper channel 212 and the lower channel 213. The upper channel 212 is connected with the water inlet joint 22 while the lower channel 213 is connected with the water outlet joint 23. Thereby, the fluid flows through the upper channel 212 and then performs heat exchange with the cold end 11 of the thermoelectric cooler 10 to lower the temperature. Subsequently, the fluid flows through the loop channel 214 and then the lower channel 213 for exchanging heat with the heat source 9, therefore improving the performance of heat dissipation significantly.

To sum up, the liquid cooling device having the diversion mechanism is capable of solving the problems that the current liquid cooling devices encountered. Further, the liquid cooling device is novel, non-obvious to the person skilled in the art and industrially applicable, and the disclosure is not publicly known prior to the filing of the patent application. Thus, the disclosure is comply with Patent Act and is filed accordingly.

What is claimed is:

1. A liquid cooling device having a diversion mechanism, connected with a heat source, comprising:

a thermoelectric cooler having a cold end and a hot end;

a first water block disposed between the heat source and the cold end of the thermoelectric cooler, wherein the first water block has a first surface and a second surface opposite to each other, the first water block is disposed on the cold end of the thermoelectric cooler via the first surface, and the second surface is directly in thermal contact with the heat source; and a second water block disposed on the hot end of the thermoelectric cooler, such that the first water block, the thermoelectric cooler and the second water block are stacked directly on each other in a direction perpendicular to the heat source; and a pump connecting the first water block and the second water block via a water pipe, wherein the pump supplies water to the first water block and second water block simultaneously by way of the water pipe, thus forming a circulation of water, and heat generated by the heat source is directly conducted into the circulation of water via the second surface of the first water block.

2. The liquid cooling device according to claim 1, further comprising a pair of heat transfer members, wherein one of the heat transfer members is disposed between the cold end of the thermoelectric cooler and the first water block while the other heat transfer member is disposed between the hot end of the thermoelectric cooler and the second water block.

3. The liquid cooling device according to claim 2, wherein the heat transfer member comprises a plurality of cooling fins.

4. The liquid cooling device according to claim 1, wherein the first water block comprises a main body, a water inlet joint and a water outlet joint, the main body is attached to the cold end of the thermoelectric cooler, and the water inlet joint and the water outlet joint are respectively plugged in and connected with the inside of the main body.

5. The liquid cooling device according to claim 4, wherein the second water block comprises a main body, a water inlet joint and a water outlet joint, the main body of the second water block is attached to the hot end of the thermoelectric cooler, and the water inlet joint of the second water block and the water outlet joint of the second water block are respectively plugged in and connected with the inside of the main body of the second water block.

6. The liquid cooling device according to claim 5, wherein the water pipe comprises a main pipe, two secondary manifolds and a tee joint, two ends of the main pipe are connected to the pump and the tee joint respectively, two ends of one of the secondary manifolds are connected to the tee joint and the water inlet joint of the first water block, respectively, while two ends of the other secondary manifold are connected to the tee joint and the water inlet joint of the second water block, respectively.

7. A liquid cooling device adapted to remove heat from a heat source, the liquid cooling device comprising:

a thermoelectric cooler having a cold end and a hot end;

a first water block disposed between the heat source and the cold end of the thermoelectric cooler, wherein the first water block has a first surface and a second surface opposite to each other, the first water block is disposed on the cold end of the thermoelectric cooler via the first surface, and the second surface is configured to directly thermally contact the heat source;

a second water block disposed on the hot end of the thermoelectric cooler, such that the first water block, the thermoelectric cooler and the second water block are stacked directly on each other in a direction perpendicular to the heat source; and a pump connecting the first water block and the second water block via a water pipe, wherein the pump supplies water to the first water block and second water block simultaneously by way of the water pipe, thus forming a circulation of water, and heat generated by the heat source is directly conducted into the circulation of water via the second surface of the first water block, wherein a separating plate is disposed in the inside of the main body, and an upper channel and a lower channel are connected to each other and respectively formed on two sides of the separating plate, the upper channel is located between the thermoelectric cooler and the lower channel, and the upper channel is connected with a water inlet joint of the first water block while the lower channel is connected with a water outlet joint of the first water block.

8. The liquid cooling device according to claim 1, further comprising an air-cooled radiator connecting the first water block, the second water block and the pump via a liquid tube.

9. The liquid cooling device according to claim 8, wherein the liquid tube comprises a main pipe, two secondary manifolds and a tee joint, the first water block comprises a water outlet joint, the second water block also comprises a water outlet joint, two ends of the main pipe are connected to the pump and the tee joint respectively, two ends of one of the secondary manifolds are connected to the tee joint and the water outlet joint of the first water block, respectively, while two ends of the other secondary manifold are connected to the tee joint and the water outlet joint of the second water block, respectively.

10. The liquid cooling device according to claim 8, further comprising a fan arranged on the air-cooled radiator.

11. The liquid cooling device according to claim 8, further comprising a liquid storage container connected with the liquid tube.

* * * * *